US007427300B2

(12) United States Patent
Soane et al.

(10) Patent No.: US 7,427,300 B2
(45) Date of Patent: Sep. 23, 2008

(54) HYDROPHILIC FINISH FOR FIBROUS SUBSTRATES

(75) Inventors: David S. Soane, Piedmont, CA (US); Dan B. Millward, Alameda, ID (US); Matthew R. Linford, Provo, UT (US); Ryan Lau, Berkeley, CA (US); Eric G. Green, New York, NY (US); William Ware, Jr., Redwood City, CA (US)

(73) Assignee: Nano-Tex, Inc., Oakland, CA (US)

( * ) Notice: Subject to any disclaimer, the term of this patent is extended or adjusted under 35 U.S.C. 154(b) by 369 days.

(21) Appl. No.: 11/089,685

(22) Filed: Mar. 24, 2005

(65) Prior Publication Data

US 2005/0183203 A1 Aug. 25, 2005

Related U.S. Application Data

(63) Continuation of application No. 10/136,191, filed on May 1, 2002, now abandoned, which is a continuation-in-part of application No. 09/766,494, filed on Jan. 18, 2001, now abandoned.

(60) Provisional application No. 60/214,059, filed on Jun. 26, 2000, provisional application No. 60/176,649, filed on Jan. 18, 2000.

(51) Int. Cl.
*C11D 1/83* (2006.01)
*C11D 3/395* (2006.01)

(52) U.S. Cl. ..... 8/115.51; 252/186.2; 510/220; 510/221; 510/235; 428/361; 428/365; 427/342; 427/389; 162/72; 162/76

(58) Field of Classification Search ..... 8/185, 8/181, 115.51; 162/72, 76; 428/361, 365; 427/342, 389; 510/220, 221, 235; 252/186.2
See application file for complete search history.

(56) References Cited

U.S. PATENT DOCUMENTS

| | | | | |
|---|---|---|---|---|
| 3,066,113 | A | 11/1962 | Arnold | |
| 3,592,686 | A | 7/1971 | Barber et al. | |
| 3,650,801 | A | 3/1972 | Hinton, Jr. et al. | |
| 3,824,125 | A | 7/1974 | Hinton, Jr. et al. | |
| 3,948,838 | A | 4/1976 | Hinton, Jr. et al. | |
| 3,959,230 | A | 5/1976 | Hays | |
| 4,075,263 | A | 2/1978 | Lane et al. | |
| 4,329,391 | A | 5/1982 | McAlister | |
| 4,330,588 | A | 5/1982 | Larson et al. | |
| 4,370,143 | A | 1/1983 | Bauer | |
| 4,563,507 | A | 1/1986 | Dyer | |
| 4,672,005 | A | 6/1987 | Dyer | |
| 4,689,159 | A | 8/1987 | Makashima | |
| 4,705,831 | A | 11/1987 | Dyer | |
| 4,726,968 | A | 2/1988 | Hayashi et al. | |
| 4,790,907 | A | 12/1988 | Mallen et al. | |
| 4,806,125 | A | 2/1989 | Dyer | |
| 4,865,886 | A * | 9/1989 | Itoh et al. | 427/342 |
| 4,921,890 | A | 5/1990 | Hayashi et al. | |
| 5,154,727 | A | 10/1992 | Dyer | |
| 5,288,544 | A | 2/1994 | Mallen et al. | |
| 5,540,964 | A | 7/1996 | Mallen | |
| 5,755,828 | A * | 5/1998 | Westland | 8/185 |
| 5,855,623 | A | 1/1999 | English et al. | |
| 5,863,665 | A | 1/1999 | Kale et al. | |
| 5,912,218 | A * | 6/1999 | Chatterjee et al. | 510/220 |
| 6,238,441 | B1 | 5/2001 | Wallace et al. | |
| 6,787,245 | B1 | 9/2004 | Hayes | |
| 6,936,115 | B2 * | 8/2005 | Mallon et al. | 148/23 |
| 2002/0187264 | A1 * | 12/2002 | Mallon et al. | 427/282 |
| 2003/0101518 | A1 | 6/2003 | Linford et al. | |

FOREIGN PATENT DOCUMENTS

| | | | |
|---|---|---|---|
| EP | 0 164 554 | A2 | 12/1985 |
| EP | 0 164 554 | A3 | 12/1985 |
| EP | 0 164 554 | B1 | 12/1985 |
| EP | 0 651 088 | A1 | 5/1995 |
| EP | 0 651 088 | B1 | 5/1995 |
| EP | 0 945 544 | A2 | 9/1999 |
| EP | 0 945 544 | A3 | 9/1999 |
| JP | 63-59481 | A | 3/1988 |
| JP | 11-293564 | A | 10/1999 |
| TW | 429280 | | 4/2001 |
| WO | WO-02/059404 | A2 | 8/2002 |
| WO | WO-02/059404 | A3 | 8/2002 |
| WO | WO-03/093567 | A1 | 11/2003 |
| WO | WO-03/097925 | A1 | 11/2003 |

OTHER PUBLICATIONS

Ahmed. (Nov. 1986). *Pakistan Textile Journal*, pp. 35-38.
Ferguson. (Jun. 1982). *American Dyestuff Reporter*, pp. 43-47.
Gillibrand. (Aug. 31, 1978). *Colourage*, pp. 49-51.
Hayes et al. (Apr. 1977). *Textile Research Journal*, pp. 277-282.
Kanebo Ltd., Database WPI XP002227416, Section Ch, Week 199816, AN 1988-109820, abstract of JP 63 059481 A (Mar. 15, 1988). Abstract Only.
Morozova, et al. (1979). *Prepr. Short. Contrib.—Bratislava IUPAC Int. Conf. Modif. Polym.*, 5th, pp. 128-132.
Nogi et al. (1976). *Chemical Abstracts* 85:95692, abstracts of Japan, Kokai "Modified Polyamide Fibers," American Chemical Society.
Perry. (May 20, 1968). *American Dyestuff Reporter*, pp. 42-45.
Sherman et al. (May 1969). *Textile Research Journal*, pp. 449-459.
Textillipari Kutato Intezet. (1972). *Chemical Abstracts* 77:21527, abstract of German OLS 2143014, American Chemical Society.
Toray Ind. Inc., Patent Abstracts of Japan, vol. 200, No. 01, Jan. 31, 2000, abstract of JP 11293564 A (Oct. 26, 1999). Abstract Only.

* cited by examiner

*Primary Examiner*—Vasu Jagannathan
*Assistant Examiner*—Preeti Kumar
(74) *Attorney, Agent, or Firm*—Jacqueline S. Larson

(57) ABSTRACT

This invention is directed to fabric finishes or treatment preparations for nylon, polyester, and other textile and fibrous substrate materials that will render them hydrophilic. The finishes of the invention are comprised primarily of polymers that contain carboxyl groups, salts of carboxyl groups, or moieties that can be converted to carboxyl groups by some chemical reaction.

1 Claim, No Drawings

HYDROPHILIC FINISH FOR FIBROUS SUBSTRATES

This application is a continuation-in-part of copending U.S. application Ser. No. 09/766,494, filed Jan. 18, 2001, which application claims the benefit of Provisional U.S. application Ser. No. 60/176,649, filed Jan. 18, 2000, and claims the benefit of Provisional U.S. application Ser. No. 60/214,059, filed Jun. 26, 2000. The entire disclosures of these applications are incorporated herein by reference.

FIELD OF THE INVENTION

This invention is directed to the field of fabric finishes, and more particularly to polymeric fabric finishes that impart hydrophilicity and other properties to fibers, yarns, textiles, or other fibrous substrates.

BACKGROUND OF THE INVENTION

Synthetic textile materials, such as nylon and polyester, are uncomfortable to wear due to their poor permeability to water. In hot weather, sweat cannot easily penetrate (or wick) through these fabrics and evaporate. The poor wicking and permeability are due to the natural hydrophobicity of nylon and polyester polymers; water does not readily spread out over surfaces composed of these materials. Nylon and polyester also often exhibit static cling and stain retention due to their hydrophobicity.

A method for imparting durable hydrophilic properties to nylon, polyester, and other synthetic materials would thus be desirable. This may be achieved by attaching hydrophilic materials to the hydrophobic fibers. Imparting hydrophilic properties to the hydrophobic substrate will also diminish or eliminate static cling and enable the release of stains during laundering.

U.S. Pat. No. 3,377,249 to Marco discloses the application of a stain-releasing finish to fabrics made of polyester, cotton, and polyester/cotton blends. The formulations comprise an acrylate copolymer (composed of at least 20% acrylic acid monomer) emulsion, an aminoplast resin, and a resin catalyst. The fabrics thus treated show stain-releasing properties durable to between five and ten home launderings.

Michielsen and Tobiesen have reported a method of grafting poly(acrylic acid) (or PAA) onto nylon 6,6 films (Tobiesen, F.A., Michielsen, S.; *J. Poly. Sci. A;* 40, 719-728 (2002)). In this method, nylon 6,6 films were dipped in aqueous solutions containing PAA, 1-ethyl-3-(3-dimethylaminopropyl) carbodiimide (EDC) and N-hydroxysuccinimide (NHS). It is reported that the carboxylates of the PAA are activated by reaction with EDC; some of the activated carboxylates then react with amine groups on the chain ends of the nylon polymers while the rest are hydrolyzed back to carboxylate form. The NHS is believed to aid in slowing the rate of hydrolysis. After incubating the film in the solutions for times ranging from 0.5 to 18 hours, and at temperatures ranging from 0 to 60° C., the treated films were removed and rinsed at least six times with deionized water. The authors report that a drop of water placed on untreated nylon 6,6 film spreads slowly over the surface, whereas a drop placed on a treated film immediately spreads to cover the surface. Disadvantages to this method are that large amounts of the expensive reagents EDC and NHS, in greater-than-stoichiometric amounts relative to the number of carboxyl groups, are required for grafting.

Herein is disclosed the invention of a treatment for polyester, nylon, and other synthetic, hydrophobic materials that renders the treated material hydrophilic. The treatment durably attaches hydrophilic material directly to a hydrophobic substrate, rendering the substrate hydrophilic without altering the other properties of the material.

SUMMARY OF THE INVENTION

This invention is directed to fabric finishes or treatment preparations for nylon, polyester, and other synthetic or hydrophobic textile materials that will render them hydrophilic.

The finishes of the invention are comprised primarily of polymers that contain carboxyl groups, salts of carboxyl groups, or moieties that can be converted to carboxyl groups by a chemical reaction (referred to herein as "carboxyl precursors"). Fibrous substrates, such as textiles or webs, are exposed to these carboxyl-containing polymers, then dried and cured. By this process, the fibers of the treated substrates are directly bonded to the hydrophilic carboxyl-containing polymers without the use of "activating reagents". The treated textiles or webs are thus endowed with hydrophilic characteristics, including improved water-wicking and breathability, in comparison to untreated textiles of the same fiber type.

This invention is further directed to synthetic or hydrophobic fibers, and yarns, fabrics, textiles, finished goods, or nonwoven goods (encompassed herein under the terms "fibrous substrates", "textiles" or "webs"), which are treated with the hydrophilic treatment preparations of the invention. The treated fibers and fibrous substrates exhibit hydrophilic characteristics in comparison to untreated fibers and fibrous substrates of the same fiber type.

DETAILED DISCUSSION OF THE INVENTION

According to the present invention, a fibrous substrate is exposed to a solution that contains a polymer or oligomer that contains carboxyl, carboxylate, or carboxyl precursor groups (all of which polymers or oligomers are encompassed herein and in the claims under the terms "carboxyl-containing polymer" or "polycarboxylate"). The treated web is then dried and cured to durably fix the hydrophilic agent to the fiber. Cross-linking agents may be used to enhance fixation of the carboxyl-containing polymer. Wetting agents may be used to facilitate application of the polymer to the web, and a catalyst, such as sodium hypophosphite, may be added. By "durably fix" or "durable" is meant that the hydrophilic properties provided to the treated substrates by the treatment finish of the invention remain for at least about 10 home launderings, preferably for at least about 35 home launderings, and more preferably for at least about 50 home launderings. In a preferred embodiment, the treatment is permanent; that is, the hydrophilic characteristics are present for the life of the treated fibrous substrate.

The carboxyl-containing polymers, according to the invention, can be obtained through polymerization or copolymerization of one or more monomers that contain a carboxyl group, a carboxylate, or a group that can become a carboxyl or carboxylate group through a chemical reaction (a carboxyl precursor group). Non-limiting examples of such monomers include: acrylic acid, methacrylic acid, aspartic acid, glutamic acid, β-carboxyethyl acrylate, maleic acid, monoesters of maleic acid [ROC(O)CH═CHC(O)OH, where R represents a chemical group that is not hydrogen], maleic anhydride, fumaric acid, monoesters of fumaric acid [ROC(O)CH═CHC(O)OH, where R represents a chemical group that is not hydrogen], acrylic anhydride, crotonic acid, cinnamic acid, itaconic acid, itaconic anhydride, monoesters of itaconic acid [$ROC(O)CH_2(=CH_2)C(O)OH$, where R represents a chemical group that is not hydrogen], saccharides with carboxyl (e.g. alginic acid), carboxylate, or carboxyl precursor groups, and macromonomers that contain carboxyl, carboxylate, or carboxyl precursor groups. Carboxyl precursors include, but are not limited to, acid chlorides, N-hydroxysuccinimidyl esters, amides, esters, nitrites, and anhydrides. Examples of monomers with carboxyl precursor groups include (meth)acrylate chloride, (meth)acrylamide, N-hydroxysuccinimide (meth)acrylate, (meth)acrylonitrile, asparigine, and glutamine. Herein the designation "(meth) acryl" indicates both the acryl- and methacryl- versions of the monomer. Preferred carboxylate cations include aluminum, barium, chromium, copper, iron, lead, nickel, silver, strontium, zinc, zirconium, and phosphonium ($R_4P^+$). More preferred cations include hydrogen, lithium, sodium, potassium, rubidium, ammonium, calcium, and magnesium. The polymers may be linear or branched. In a presently preferred embodiment, the polymers are branched, and more preferably they have between about 0.001% and about 10% branching, inclusive. Preferred monomers are acrylic acid, methacrylic acid and β-carboxyethyl acrylate.

Acrylate polymers containing carboxyl groups are commercially available. In particular, poly(acrylic acid) is in wide production worldwide for use as a "super-absorbent" in disposable diapers and as a thickener in printing pastes. Poly (acrylic acid) can be obtained from, among other sources, Polycryl AG, Bohler, Postfach, CH-6221 Rickenbach, Switzerland (trade name: Polycryl); Stockhausen, 2401 Doyle Street, Greensboro, N.C., 27406-2911; and BFGoodrich, Four Coliseum Centre, 2730 West Tyvola Rd., Charlotte, N.C. 28217-4578 (trade name: Carbopol). The presently preferred polycarboxylate is poly(acrylic acid) (PAA).

The present invention is further directed to synthetic or hydrophobic yarns, fibers, fabrics, finished goods, or other textiles (encompassed herein under the terms "fibrous substrates", "textiles" and "webs") that are treated with the hydrophilic fabric finishes of the invention. These treated textiles or webs will display characteristics usually associated with hydrophilic textiles (e.g. cotton), such as improved wettability and moisture breathability, while retaining the traditional advantages of synthetic textiles, such as strength and durability. In addition, optical and other properties of the fiber may also be modified so as to, for example, reduce the shininess and improve the hand of synthetic fibers and fabrics. Anti-static and stain release characteristics may also be imparted by treatment according to the invention.

These treated fibrous substrates can be used in a variety of ways including, but not limited to the following: clothing, upholstery and other interior furnishings, hospital and other medical uses, and industrial uses. The *Wellington Sears Handbook of Industrial Textiles* (Ed. S. Adanur, Technomic Publishing Co., Lancaster, Pa., 1995, p. 8-11) lists a number of potential uses.

The hydrophilic fibrous substrates of the invention comprise (1) polymer chains that contain carboxyl groups, which have been cured and affixed onto (2) synthetic or hydrophobic fibers formed into a fibrous substrate. Optionally, a cross-linking agent and a catalyst may be added with the polymer to enhance the fixation of the polymer to the fiber. The fibrous substrates of the present invention are intended to include fibers, fabrics and textiles, and may be sheet-like structures (woven, knitted, tufted, stitch-bonded, or non-woven) comprised of fibers or structural elements. Included with the fibers can be non-fibrous elements, such as particulate fillers, binders, and sizes. The hydrophobic textiles or webs include fibers, woven and non-woven fabrics derived from natural or synthetic fibers or blends of such fibers. They can comprise hydrophobic fibers in the form of continuous or discontinuous monofilaments, multifilaments, staple fibers, and yarns containing such filaments and/or fibers, which fibers can be of any desired composition. Mixtures of natural fibers and synthetic fibers may also be used. Examples of natural fibers include cotton, wool, silk, jute, and linen. Examples of man-made fibers include regenerated cellulose rayon, cellulose acetate, and regenerated proteins. Examples of synthetic fibers include, but are not limited to, polyesters (including polyethyleneterephthalate and polypropyleneterephthalate), polyamides (including nylon), acrylics, olefins, aramids, azions, modacrylics, novoloids, nytrils, aramids, spandex, vinyl polymers and copolymers, vinal, vinyon, vinylon, Nomex® (DuPont) and Kevlar® (DuPont).

To prepare the fibrous substrates of the invention, a synthetic or hydrophobic fiber, yarn, fabric, textile, finished good, or non-woven good (the "fibrous substrate" or "web") is exposed to a solution or suspension of the carboxyl-containing polymer or polycarboxylate by methods known in the art, including soaking, spraying, dipping, fluid-flow, and padding. The solution or suspension may optionally include a cross-linking agent, cross-linking catalysts and/or wetting agents. The solvent may be water, an organic liquid, or a supercritical fluid. The treated web is then removed from exposure, dried, and cured. The resulting web exhibits hydrophilic characteristics that are not present in the untreated web.

Without being bound by theory, it is believed that the mechanism of fixation of the polycarboxylate to the fiber surface is the formation of covalent bonds between the two. In the case of polyester fiber, there are hydroxyl-terminated chain ends that form ester bonds with the polycarboxylate, whereas the amine-terminated chain ends of nylon form amide bonds with the polycarboxylate; these bonds are believed to form during the curing process. While ester and amide bonds are reasonably strong, they can still be subject to hydrolysis during laundering procedures. It is believed that the durability of the finish corresponds to the number of covalent bonds between the polycarboxylate and the fiber surface; as a result, it is preferable to form as many bonds as possible to maximize the durability of the hydrophilic finish. However, the "density" of reactive groups over a given area of synthetic fiber surface is expected to be quite small. Michielsen reports that Nylon 6,6 has only one reactive amine group per 90 $nm^2$ (Michielsen, S.; *J. Appl. Polym. Sci.* 1999, 73, 129-136). As comparison, 5-kD poly(acrylic acid) has a radius of gyration, $R_G$, of less than 5 nm, so on average only one amide bond could be formed between each polymer chain and the surface. As the density of reactive groups of the fiber surface cannot be increased without damaging the fibers, the only available method to maximize the number of fiber-polycarboxylate bonds is to use high molecular weight polycarboxylates so that surface coverage is maximized. Such polycarboxylates may be prepared by cross-linking lower molecular weight polycarboxylates either previous to or concurrently with the curing process. Cross-linked polycarboxylates of high molecular weight are commercially available from sources cited herein.

The polycarboxylate polymers can be cross-linked together by including a cross-linking agent, a molecule that contains two or more carboxyl-reactive groups, in the treatment bath. Non-limiting examples of carboxyl-reactive groups include alcohols, amines, thiols, aminoplasts (e.g. condensation products of ureas and aldehydes), and oxazolines. It is desirable that the cross-linking agent be non-volatile at or below the curing temperature; to this end, polymeric or high molecular weight cross-linking agents are of value. It is further desirable that the cross-linking agent be soluble or readily suspended in the bath liquor. Examples of alcohol cross-linking agents include glycerol and other non-polymeric polyols (including α, ω-diols such as 1,5-pentanediol), poly(ethylene glycol), poly(vinyl alcohol) and poly(saccharides). The poly(saccharides) may be either found in nature or derivatized from natural sources and may include celluloses, agars, pectins, xanthan gums and guar gums. Examples of amine cross-linkers include polyamines, poly(vinyl amine) and poly(ethylene imine). Examples of aminoplast cross-linkers include dimethyloldihydroxyurea (DMDHEU) and related urea-aldehyde condensation products as well as polymers containing aminoplast reactive groups. Examples of oxazoline cross-linkers include the Epocros product line from Nippon Shokubai (2651 Riverport Rd. Chattanooga, Tenn. 37406).

If polymers that contain carboxyl precursor groups are used as the carboxyl-containing polymer, the precursors must be hydrolyzed to form carboxyl groups either during or after application of the finish to the textile. Conditions for hydrolysis depend on the nature of the precursors. Preferably, the hydrolysis occurs at the pH and temperature conditions at which the fibrous substrate is treated, so as to facilitate formation of the carboxyl groups as the polymer is being applied to the textile or web. Preferred precursor groups are acid chlorides and anhydrides. Less preferred precursor groups may require acidic or basic aqueous conditions and elevated temperatures for hydrolysis; such groups include esters and amides.

A preferred molecular weight of the carboxyl-containing polymer useful in the present invention is between about 90 and about 4,000 kilodaltons; a more preferred molecular weight is between about 125 and about 3,000 kilodaltons, and a most preferred molecular weight is between about 750 and about 1,250 kilodaltons. It is preferred that the polycarboxylate be cross-linked between about 0.001% and about 10%, more preferably between about 0.01% and about 1%. The molecular weight and degree of cross-linking can be obtained either prior to making the finish formulation or during the course of curing the finish onto the web.

The amount of carboxyl-containing polymer and other substituents in the treatment solution will depend on factors such as the particular polymer(s) used, the degree of hydrophilicity desired, and the like. Generally, the carboxyl-containing polymer is present in the treatment solution in an amount of from about 0.001 wt. % to about 25 wt. %, preferably from about 0.005 wt. % to about 5 wt. %, more preferably from about 0.01 wt. % to about 2 wt. %. The cross-linking agent is present in an amount from 0 wt. % to about 10 wt. %, preferably from about 0 wt. % to about 1 wt. %, more preferably from about 0 wt. % to about 0.5 wt. %. The catalyst is present in an amount from 0 wt. % to about 4 wt. %, preferably from about 0 wt. % to about 2 wt. %, more preferably from about 0 wt. % to about 1.5 wt. %. The wetting agent is present in an amount from 0 wt. % to about 5 wt. %, preferably from about 0.01 wt. % to about 1 wt. %, more preferably from about 0.05 wt. % to about 0.5 wt. %.

In applying the hydrophilic carboxyl-containing polymers of the invention to a fiber or fibrous substrate, the process temperature can vary widely, depending on the reactivity of the reactants. However, the temperature should not be so high as to decompose the reactants or so low as to cause inhibition of the reaction or freezing of the solvent. Unless specified to the contrary, the textile is exposed to the polymer at atmospheric pressure over a temperature range between 5° C. and 110° C., more preferably between 15° C. and 60° C., and most preferably at room temperature, approximately 20° C. The pH at which the carboxyl-containing polymer is applied may be between pH 0 to pH 7, preferably between pH 1 to pH 5, and more preferably between pH 2 to pH 4.5. The time required for the processes herein will depend to a large extent on the temperature being used and the relative reactivities of the starting materials. Unless otherwise specified, the process times and conditions are intended to be approximate. Curing conditions may range from 5° C. to 250° C., preferably between 150° C. and 200° C.

EXAMPLES

General Information:

In the Rotawash™ procedure, a square piece of fabric (approximately 2.5"×6" or 6.4 cm×15.2 cm) is placed in a metal canister with 100 stainless steel beads and 50 mL of 0.15 wt. % laundry detergent solution. The canister is then rotated in a water bath at 71° C. Each nine-minute cycle in the Rotawash machine is taken as the equivalent of one home laundering (HL) in a conventional washing machine. After completion of the desired number of cycles, the sample is removed from the canister, rinsed with flowing tap water for 2 minutes, and dried in an oven at 100° C.

The hydrophilicity/phobicity of a fabric swatch is determined by placing six drops of water on various locations on the swatch. The swatch is suspended so that the areas where the drops are placed are not in contact with any solid support or other material that could induce the wicking of water. The time required for each drop to soak into the fabric is measured, recorded and averaged. If the "time to soak" is greater than 120 seconds, the value is recorded as 120 seconds. The hydrophilicity of any particular swatch is determined by its average wicking time.

Example 1

A sample of unfinished nylon was dipped in an aqueous solution of 0.5 wt. % polyacrylic acid (average molecular weight 90,000, Sigma-Aldrich) and 0.1% Wetaid™ NRW wetting agent (B.F. Goodrich), and was padded to a wet pick-up of approximately 100%. A control sample was dipped in tap water and padded similarly. The samples were dried at 120° C. for 60 seconds, then cured at 180° C. for 30 seconds. The samples were laundered according to the rotawash procedure described above for 1, 6, 11, 21, 31, 96, and 118 cycles. The hydrophilicity of the swatches was measured as described above; results are recorded in Table 1.

TABLE 1

| Parameters: | Fabric Wet Time (seconds) | |
|---|---|---|
| # of cycles | Treated | Untreated |
| 1 | 6 | 429 |
| 6 | 9 | 251 |
| 11 | 6 | 214 |
| 21 | 8 | 166 |
| 31 | 5 | N/A |
| 96 | N/A | 154 |
| 118 | 5 | N/A |

Example 2

Four 300.0 g solutions of 0.25% PAA and 0.3% Wetaid NRW (Noveon) were prepared from four different PAA materials: Carbopol 846 (Noveon), Carbopol 1392WC (Noveon), Carbopol PKS (Noveon), and 1.25M mol. wt. 0.1% crosslinked ("ALD"; Sigma-Aldrich). The viscosity measurements recorded in Table 2 were made on solutions of slightly greater than pH 8.0 as adjusted with ammonium hydroxide; this information was provided by the manufacturers. Swatches from two styles of nylon (1 and 2) were each dipped in one of the treatment baths, padded, then dried at 248° F. (120° C.) for 1 minute and cured at 300° F. (149° C.) for 30 seconds. Untreated swatches of each fabric were used as controls (noted as "N/A" in the table). The hydrophilicity of the swatches were measured as described above, then the swatches were laundered twice according to AATCC method 124-96, after which the hydrophilicity was measured again.

TABLE 2

| Parameters | | | Fabric Wet Time (seconds) | |
|---|---|---|---|---|
| | Viscosity, cP | | | |
| PAA | (% solids) | Style | 0 HL | 2 HL |
| 846 | 35000 (3.5) | 1 | 2.3 | 80.5 |
| 1392WC | 15000 (3.5) | 1 | 1.5 | 120.0 |
| PKS | 20000 (3.0) | 1 | 103.8 | 120.0 |
| ALD | 40000 (0.5) | 1 | 1.2 | 24.5 |
| N/A | N/A | 1 | 120.0 | 120.0 |
| 846 | 35000 (3.5) | 2 | 3.2 | 120.0 |
| 1392WC | 15000 (3.5) | 2 | 3.8 | 120.0 |
| PKS | 20000 (3.0) | 2 | 120.0 | 120.0 |
| ALD | 40000 (0.5) | 2 | 2.7 | 40.5 |
| N/A | N/A | 2 | 120.0 | 120.0 |

Example 3

Two aqueous pad bath solutions (A and B) were prepared with 0.25% PAA and 0.3% Wetaid NRW in each solution. Solution A contained 1.25 million molecular weight PAA, 0.1% crosslinked (Sigma-Aldrich); solution B contained 1.0 million molecular weight PAA, linear (Polacryl A10,000-10A). Swatches of two styles of nylon (1 and 2) were dipped in either solution and padded to consistent wet pick up. The swatches were dried for one minute at 248° F., then cured at 300° F. for 30 seconds. Swatches were tested for hydrophilicity by the drop test as described above, then laundered and re-tested as desired. Launderings were performed according to AATCC method 124-96 (II.1.IV.A) with extra rinse cycle. Results are described in Table 3.

TABLE 3

| Parameters | | Wet Times | |
|---|---|---|---|
| Solution | Nylon Style | O HL | 2 HL |
| A | 1 | 1.2 | 8.0 |
| B | 1 | 2.8 | 29.7 |
| None (control) | 1 | 120.0 | 86.5 |
| A | 2 | 68.5 | 11.3 |
| B | 2 | 81.7 | 42.2 |
| None (control) | 2 | 120.0 | 89.3 |

Example 4

Samples of two styles (1 and 2) of nylon 6,6 were dipped in one of four aqueous solutions of 0.25 wt. % polyacrylic acid and 0.1% Wetaid™ NRW (B.F. Goodrich). Four commercially available polyacrylic acid (PAA) formulations were tested.

Polymers: A=1,250K mol. wt. PAA with 0.1% branching (from Aldrich)

P2=1,000K mol. wt. linear PAA, pH=2.0 (from Polycryl)

P33=1,000K mol. wt. linear PAA, pH=3.3 (from Polycryl)

S=1,000K mol. wt. linear PAA (from Stockhausen).

The pad baths were heated at 90° F. (32° C.). The samples were dipped, then padded to approximately 50% wet pick-up, dried at 250° F. (121° C.) for 1 min., and finally cured at 300° F. (149° C.) for 15 seconds. Control samples were not treated in any way. The samples (including controls) were subjected to a specified number of Rotawash™ laundering simulations (see above) and dried, following the procedure described previously. Fabric hydrophilicity was measured as described above and the results are recorded in Table 4.

TABLE 4

| Parameters | | Fabric Wet Time (Seconds) | |
|---|---|---|---|
| PAA | Nylon Style | 0 HL | 2 HL |
| A | 1 | 3.0 | 2.0 |
| P2 | 1 | 1.2 | 75.5 |
| P33 | 1 | 2.0 | 48.7 |
| S | 1 | 2.3 | 80.3 |
| A | 2 | 5.0 | 2.3 |
| P2 | 2 | 2.0 | 93.3 |
| P33 | 2 | 3.3 | 57.2 |
| S | 2 | 2.3 | 120.0 |

Example 5

A 1200 g aqueous solution of 0.25% 1.25M mol. wt. PAA, 0.1% crosslinked (Sigma-Aldrich) and 0.3% Wetaid NRW (Noveon) was prepared. The solution had a pH of 3.74. The solution was divided into six 200 g portions. The pH of each solution was adjusted to match one of these values: 3.0, 3.25, 3.5, 3.75, 4.0, and 4.25. The pH adjustments were made with either sodium hydroxide or sulfuric acid solutions (10%). At pH 3.21 a white precipitate forms, so the pH 3.0 solution was discarded. At pH 4.25, the solution was too viscous for pad application, so it too was discarded. The remaining four solutions were used as pad baths for swatches of nylon fabric corresponding to each pad bath solution. A fifth swatch was padded through water. The swatches; were dried one minute at 250° F., then cured at 300° F. for 15 seconds. The swatches were tested for hydrophilicity as described above, then laundered ten times according to AATCC method 124-96 as referenced herein and tested again; hydrophilicity data is recorded in Table 5.

TABLE 5

| Parameters | Fabric Wet Time (seconds) | |
|---|---|---|
| Solution pH | 0 HL | 10 HL |
| 3.25 | 1.8 | 1.5 |
| 3.50 | 1.2 | 1.3 |
| 3.75 | 1.5 | 1.2 |
| 4.00 | 1.3 | 3.5 |
| control | 120.0 | 99.3 |

Example 6

Five aqueous solutions containing 1.25M mol. wt. PAA, 0.1% crosslinked (Sigma-Aldrich) and 0.3% Wetaid NRW (Noveon) were prepared. The weight percent of PAA in each solution corresponded to one of these five values: 0.25, 0.20, 0.15, 0.10, 0.05. Swatches corresponding to each of the five solutions were prepared from two styles of nylon fabric (1 and 2). The swatches were padded in the appropriate solution, dried one minute at 250° F., then cured at 300° F. for 30 seconds. The swatches were tested for hydrophilicity as described above, then laundered one time according to AATCC method 124-96 as referenced herein and tested again. The results are presented in Table 6.

TABLE 6

| Parameters | | Fabric Wet Time (seconds) | |
|---|---|---|---|
| wt % PAA | Nylon Style | 0 HL | 1 HL |
| 0.25 | 1 | 1.3 | 4.8 |
| 0.2 | 1 | 1.5 | 4.7 |
| 0.15 | 1 | 2.0 | 16.3 |
| 0.1 | 1 | 1.0 | 36.0 |
| 0.05 | 1 | 1.5 | 33.8 |
| control | 1 | 120.0 | 120.0 |
| 0.25 | 2 | 1.2 | 4.5 |
| 0.2 | 2 | 1.0 | 3.2 |
| 0.15 | 2 | 1.0 | 10.3 |
| 0.1 | 2 | 1.0 | 6.7 |
| 0.05 | 2 | 1.0 | 54.0 |
| control | 2 | 120.0 | 120.0 |

Example 7

Four aqueous solutions containing PAA (1.25M mol. wt., 0.1% crosslinked; Sigma-Aldrich) and 0.3% Wetaid NRW (Noveon) were prepared. The weight percent of PAA in each solution corresponded to one of these four values: 0.25, 0.20, 0.15, 0.10. Swatches corresponding to each of the four solutions were prepared from three styles of nylon fabric (1, 2 and 3). Control swatches were padded through water. The swatches were padded in the appropriate solution, dried one minute at 250° F., then cured at 300° F. for 15 seconds. The swatches were tested for hydrophilicity as described above, then laundered nineteen times according to AATCC method 124-96 as referenced herein and tested again. The results are presented in Table 7.

TABLE 7

| Parameters | | Fabric Wet Time (seconds) | |
|---|---|---|---|
| wt % PAA | Nylon Style | 0 HL | 19 HL |
| 0.25 | 1 | 1.0 | 1.5 |
| 0.20 | 1 | 1.2 | 1.2 |
| 0.15 | 1 | 1.0 | 3.3 |
| 0.10 | 1 | 2.0 | 5.8 |
| control | 1 | 120.0 | 25.0 |
| 0.25 | 2 | 6.5 | 2.0 |
| 0.20 | 2 | 7.7 | 4.5 |
| 0.15 | 2 | 13.5 | 2.5 |
| 0.10 | 2 | 28.7 | 8.5 |
| control | 2 | 120.0 | 66.2 |
| 0.25 | 3 | 1.0 | 15.8 |
| 0.20 | 3 | 1.0 | 14.7 |
| 0.15 | 3 | 1.2 | 19.0 |
| 0.10 | 3 | 2.0 | 21.8 |
| control | 3 | 120.0 | 57.2 |

Example 8

A two-liter aqueous solution of 0.25% PAA (1.25M mol. wt., 0.1% crosslinked; Sigma-Aldrich) and 0.3% WetAid NRW was prepared. Four swatches of a nylon fabric were dipped in the solution, padded, dried at 250° F. for one minute, then cured for either 0, 10, 15, or 30 seconds at 300° F. A control swatch was dipped in water and padded, dried, and cured in like fashion. The swatches were tested for hydrophilicity as described above, laundered nine times, then tested again; the results are recorded in Table 8.

TABLE 8

| Parameters | Fabric Wet Time (seconds) | |
|---|---|---|
| Cure Time | 0 HL | 9 HL |
| 0 seconds | 3.3 | 29.2 |
| 10 seconds | 3.0 | 17.2 |
| 15 seconds | 4.8 | 17.7 |
| 30 seconds | 2.2 | 14.2 |
| control | 120.0 | 114.7 |

Example 9

Swatches of seven different styles of nylon (identified as nylon 1-7) and a polyester-nylon blend were dipped in an aqueous solution of 0.25% PAA (1.25M mol. wt.; Sigma-Aldrich) and 0.3% WetAid NRW (BFGoodrich), padded, dried for one minute at 248° F. and cured for thirty seconds at 300° F. The swatches were laundered according to AATCC method 124-96 (II.1.IV.A) (AATCC Technical Manual 2001, p. 205), and the hydrophilic properties of the swatches were tested at 0 and 10 HLs. The results are recorded in Table 9.

TABLE 9

| Parameters | | Fabric Wet Time (seconds) | |
|---|---|---|---|
| treated/ control | fabric | 0 HL | 10 HL |
| treated | nylon 1 | 1.8 | 2.5 |
| control | nylon 1 | 120.0 | 33.8 |
| treated | nylon 2 | 3.0 | 2.8 |
| control | nylon 2 | 120.0 | 45.7 |
| treated | nylon 3 | 1.2 | 2.2 |
| control | nylon 3 | 120.0 | 5.2 |
| treated | nylon 4 | 5.8 | 0.5 |
| control | nylon 4 | 120.0 | 11.0 |
| treated | nylon 5 | 0.2 | 0.0 |
| control | nylon 5 | 2.0 | 0.0 |
| treated | nylon 6 | 3.5 | 1.5 |
| control | nylon 6 | 73.0 | 2.7 |
| treated | nylon 7 | 1.0 | 1.7 |
| control | nylon 7 | 6.7 | 14.8 |
| treated | poly-nylon | 4.3 | 13.2 |
| control | poly-nylon | 120.0 | 44.7 |

Example 10

Seven swatches of navy blue polyester fabric (15.2×15.2 cm) were dipped in an aqueous solution of 0.25% poly (acrylic acid) (Carbopol 820; BFGoodrich) and 0.3% WetAid NRW (BFGoodrich). A control swatch was dipped in water. The swatches were padded to 70% wet pick up, dried for five minutes at 200° F. (93° C.), and cured at varying temperatures and times, as indicated in Table 10; the control swatch was only dried. The swatches were laundered according to AATCC method 124-96 and the hydrophilic properties of the swatches were tested at 0, 10, and 20 home launderings (HLs). The hydrophilicity was measured as described above, and the results are recorded in Table 10

TABLE 10

| Parameters | | Fabric Wet Time (seconds) | | |
|---|---|---|---|---|
| Cure Temp. (° C.) | Cure Time (seconds) | 0 HL | 10 HL | 20 HL |
| 149 | 15 | 2.5 | 9 | 18.8 |
| 149 | 30 | 6.2 | 7.5 | 23.8 |
| 163 | 15 | 2 | 8.7 | 35 |
| 163 | 30 | 2.3 | 5.7 | 13.7 |
| 177 | 15 | 2.8 | 6.3 | 14.8 |
| 177 | 30 | 4.2 | 6 | 11.8 |
| 193 | 30 | 4.3 | 4.2 | 4.5 |
| N/A | N/A | 13.7 | 27.3 | 88.3 |

Example 11

Six swatches of an olive polyester fabric (all 15.2×15.2 cm) were dipped in an aqueous solution of 0.25% PAA (Carbopol 820, Noveon) and 0.2% WetAid NRW (BF Goodrich). The swatches were cured for varying times and temperatures as indicated in Table 11. An untreated swatch of the fabric was used as a control (cure time and temperature conditions are noted as "N/A" in the table). The swatches were laundered according to AATCC method 124-96, and the hydrophilic properties of the swatches were tested at 0, 20, and 40 HLs as described above; the results are presented in Table 11.

TABLE 11

| Parameters | | Fabric Wet Time (seconds) | | |
|---|---|---|---|---|
| Cure Temp. (° C.) | Cure Time (seconds) | 0 HL | 20 HL | 40 HL |
| 188 | 15 | 2.0 | 1.0 | 1.5 |
| 188 | 30 | 2.2 | 0.5 | 1.5 |
| 182 | 15 | 1.5 | 0.5 | 1.3 |
| 182 | 30 | 1.3 | 0.8 | 1.8 |
| 177 | 15 | 1.0 | 2.3 | 6.3 |
| 177 | 30 | 1.2 | 0.3 | 1.3 |
| N/A | N/A | 14.2 | 7.5 | 24.3 |

Example 12

Seven swatches of polyester fabric were dipped in an aqueous solution of 0.25% PAA (Carbopol 820, Noveon), 0.1% WetAid NRW (BFGoodrich) and 0.1% 2-butyloctanoic acid. The swatches were identified as A-G; they had an average wet pick up of 79.5±1.9% after being dipped and padded. The swatches were cured for varying times (dwell time, in seconds) and temperatures as indicated in Tables 12, 13, and 14. An untreated swatch of fabric was used as control (cure time and temperature conditions are noted as "N/A" in the table). The swatches were laundered according to AATCC method 124-96, and the hydrophilic properties of the swatches were tested at 0 and 30 HLs as described above. The results are recorded in Tables 12, 13, and 14.

TABLE 12

| Parameters | | | Fabric Wet Time (seconds) | |
|---|---|---|---|---|
| cloth | cure temp (°C.) | dwell time (sec) | 0 HL | 30 HL + extra rinse |
| D | 143 | 36 | 0.0 | 28 |
| D | 143 | 51 | 0.0 | 28 |
| D | 143 | 63 | 0.0 | 19 |
| D | 143 | 75 | 0.2 | 6 |
| D | 149 | 29 | 0.0 | 27 |
| D | 149 | 45 | 0.0 | 13 |
| D | 149 | 59 | 0.5 | 4 |
| D | 149 | 73 | 0.8 | 2 |
| C | 154 | 36 | 0.3 | 4 |
| C | 154 | 47 | 0.8 | 5 |
| C | 154 | 59 | 0.8 | 3 |
| C | 154 | 74 | 1.0 | 4 |
| C | 160 | 29 | 0.3 | 5 |
| C | 160 | 44 | 1.0 | 4 |
| C | 160 | 58 | 1.0 | 3 |
| C | 160 | 72 | 1.3 | 5 |
| B | 166 | 40 | 1.0 | 5 |
| F | 166 | 46 | 1.0 | 4 |

TABLE 13

| Parameters | | | Fabric Wet Time (seconds) | |
|---|---|---|---|---|
| cloth | cure temp (°C.) | dwell time (s) | 0 HL | 30 HL + extra rinse |
| F | 166 | 57 | 1.0 | 5 |
| B | 166 | 77 | 2.0 | 3 |
| B | 171 | 36 | 1.3 | 4 |
| B | 171 | 46 | 1.3 | 6 |
| B | 171 | 57 | 2.2 | 6 |
| B | 171 | 74 | 2.2 | 5 |
| A | 177 | 39 | 2.2 | 4 |
| A | 177 | 51 | 2.5 | 9 |
| A | 177 | 62 | 2.8 | 3 |
| A | 177 | 77 | 3.3 | 9 |
| F | 182 | 30 | 2.2 | 3 |
| A | 182 | 48 | 3.5 | 16 |
| A | 182 | 59 | 3.8 | 11 |
| A | 182 | 74 | 4.0 | 120 |
| F | 188 | 26 | 3.3 | 7 |
| E | 188 | 51 | 7.3 | 17 |
| F | 188 | 56 | 7.3 | 10 |
| E | 188 | 72 | 11.7 | 44 |

TABLE 14

| Parameters | | | Fabric Wet Time (seconds) | |
|---|---|---|---|---|
| cloth | cure temp (°C.) | dwell time (sec) | 0 HL | 30 HL + extra rinse |
| E | 193 | 27 | 4.8 | 5 |
| E | 193 | 44 | 13.0 | 55 |
| E | 193 | 58 | 18.5 | 120 |
| E | 193 | 72 | 33.3 | 120 |
| G | 199 | 29 | 11.0 | 71 |
| G | 199 | 44 | 25.2 | 120 |
| G | 199 | 58 | 51.5 | 120 |
| G | 199 | 72 | 67.0 | 120 |
| G | 204 | 30 | 19.0 | 28 |
| G | 204 | 44 | 65.3 | 120 |
| G | 204 | 59 | 120.0 | 120 |
| G | 204 | 74 | 120.0 | 120 |
| NA | untreated | untreated | 120.0 | 120 |

Example 13

Four solutions containing 0.2% PAA and 0.1% WetAid NRW (Noveon) were prepared with pH values ranging from 3.6-3.8. Each solution uniquely held one of the following four molecular weight and type of PAA:

250 Kd $M_w$, linear (250)

750 Kd $M_w$, 0.1% crosslinked (750)

1.25 Md $M_w$, 0.1% crosslinked (1.25)

3.0 Md $M_w$, 0.1% crosslinked (3.0)

Four swatches of polyester were cut and each one was dipped in one of the solutions. A fifth swatch was dipped in water adjusted to pH 3.8 with acetic acid. All the swatches were padded to an average wet pick up of 86%. The swatches were dried for five minutes at 220° F. (104° C.), then cured for thirty seconds at 340° F. (171° C.). The swatches were tested for hydrophilicity, laundered twenty times according to AATCC method 124-96, then tested again. The results are recorded in Table 15.

TABLE 15

| Parameters | | Fabric Wet Time (seconds) | |
|---|---|---|---|
| PAA Mw | % X-linked | 0 HL | 20 HL |
| N/A | N/A | 0.0 | >120 |
| 250 K | 0 | 0.0 | 42.3 |
| 750 K | 0.1 | 1.2 | 15.7 |
| 1.25 M | 0.1 | 1.2 | 24.7 |
| 3.0 M | 0.1 | 1.0 | >120 |

Example 14

Seven possible combinations of aqueous formulations of PAA (Carbopol 820; BFGoodrich), PatCoRez P-53 (DMDHEU resin, Noveon) and WetAid NRW (Noveon) were prepared, according to the weight percentage compositions listed in Table 16. Eight 6"×6" swatches of unfinished, olive polyester were prepared, and one swatch was dipped in each formulation. The eighth swatch was dipped in water. All the swatches were padded to 70% wet pick up, dried at 248° F., and cured at 380° F. for thirty seconds. The swatches were laundered according to AATCC method 124-96 as referenced herein, and the hydrophilic properties of the swatches were tested at 0, 10, and 40 HLs. The hydrophilicity data is recorded in Table 16.

TABLE 16

| | Parameters | | | Fabric Wet Time (seconds) | | |
|---|---|---|---|---|---|---|
| Row # | wt % PAA | wt % P-53 | wt % WA | 0 HL | 10 HL | 40 HL |
| 1 | 0.25 | 0.00 | 0.00 | 4.2 | 1.0 | 1.0 |
| 2 | 0.00 | 1.00 | 0.00 | 0.2 | 4.2 | 11.8 |
| 3 | 0.00 | 0.00 | 0.20 | 1.7 | 13.7 | 14.3 |
| 4 | 0.25 | 1.00 | 0.00 | 6.8 | 3.5 | 1.0 |
| 5 | 0.25 | 0.00 | 0.20 | 1.0 | 0.5 | 0.0 |
| 6 | 0.00 | 1.00 | 0.20 | 1.0 | 4.3 | 8.7 |
| 7 | 0.25 | 1.00 | 0.20 | 1.0 | 0.8 | 0.7 |
| 8 | 0.00 | 0.00 | 0.00 | 8.7 | 115.0 | 12.2 |

Example 15

A 20.0 g aqueous solution of 1% alginic acid (Sigma-Aldrich), 0.6% sodium hypophosphite (Sigma-Aldrich), 0.5% 1,2,3,4-butanetetracarboxylic acid (Sigma-Aldrich), and 0.1% Wetaid NRW (Noveon) at pH 3.2 was prepared. A nylon fabric swatch was dipped in the solution, padded at 25 psi, then dried and cured at 180° C. for five minutes. An untreated swatch was used as a control. A water drop placed on the treated fabric was absorbed in 71 seconds, whereas water required 303 seconds to soak into the untreated fabric. The swatches were then washed by the Rotawash procedure as described herein for intervals of nine and forty-five minutes. After a nine-minute rotawash, a water drop was absorbed in 49 seconds on treated fabric, but required 239 seconds to soak into an untreated swatch. After an additional forty-five minute rotawash, the treated sample absorbed a water drop in 55 seconds, whereas the control required 216 seconds.

Example 16

A 40.0 g aqueous solution of 0.5% alginic acid (Sigma-Aldrich), 0.5% polyethylene glycol (MW 200; Sigma-Aldrich), 0.5% sodium hypophosphite (Sigma-Aldrich), 0.5% 1,2,3,4-butanetetracarboxylic acid (Sigma-Aldrich), and 0.1% Wetaid NRW (Noveon) at pH 3.5 was prepared. Nylon swatches were dipped in the solution, padded at 25 psi, then dried and cured for five minutes at 180° C. A control swatch was dipped in water and treated similarly. Treated swatches absorbed water drops with an average time of 28.5 seconds, while the control swatch required more than 360 seconds. The swatches were then washed for nine minutes in the Rotawash as described above. The treated swatches absorbed water drops with an average time of 93 seconds, whereas the control swatch required more than 390 seconds.

Example 17

A 123.1 g 4% aqueous stock solution of poly(styrenesulfonic acid-co-maleic acid) (PSSA-co-MA) was prepared by dissolving 4.8 g poly(styrenesulfonic acid-co-maleic acid), sodium salt (3:1 styrene:maleic, $M_w$ 20,000) in 118.3 g water. From this stock solution, 10.0 g solutions of 1% PSSA-co-MA, 0.1% Wetaid NRW (Noveon) and 0.5% sodium hypophosphite (Sigma-Aldrich) with either 0.75% or 1.5% 1,5-pentanediol were prepared. Swatches of nylon fabric were dipped in either solution, padded at 25 psi and dried/cured at 180° C. for five minutes. A control swatch that was untreated was also prepared. The hydrophilicity of each swatch was tested by placing six separate water drops on each fabric and noting the time required for each drop to soak in. The swatches were then washed by the Rotawash procedure for either 1, 6 or 11 nine-minute cycles, after which they were dried and tested again for hydrophilicity. The average wet time for each swatch is recorded in Table 17; swatches are designated by the amount of 1,5-pentanediol (1,5-pd) in the pad formulation.

TABLE 17

| Parameters | Fabric Wet Time (Seconds) | | | |
|---|---|---|---|---|
| % 1,5-pd | 0 cycles | 1 cycle | 6 cycles | 11 cycles |
| 0.75 | 3.0 | 16.7 | 12.3 | 12.0 |
| 1.50 | 1.5 | 24.2 | 10.0 | 10.8 |
| control | 6.5 | 43.8 | 20.7 | 41.0 |

Example 18

Four 10.0 g solutions of 1% PAA (90K mol. wt.; Sigma-Aldrich), 0.5% sodium hypophosphite (Sigma-Aldrich), 0.1% Wetaid NRW (Noveon), and varying concentrations of hydroxyethylcellulose (HEC) (Sigma-Aldrich) were prepared; the HEC concentrations are given in Table 18. Individual swatches of nylon fabric were dipped in each of the formulations, pad-rolled at 25 psi pressure, then dried/cured at 180° C. for five minutes. The swatches were tested for hydrophilicity as described herein and then laundered by Rotawash for 1 and 21 nine-minute cycles, testing for hydrophilicity at those intervals. The average fabric wet times are recorded in Table 18. The untreated fabric is hydrophobic.

TABLE 18

| Parameters | Fabric Wet Time (Seconds) | | |
|---|---|---|---|
| wt. % HEC | 0 cycles | 1 cycle | 21 cycles |
| 0.75 | 24.5 | 22.8 | 6.0 |
| 0.50 | 35.7 | 6.5 | 8.0 |
| 0.10 | 43.7 | 9.5 | 6.3 |
| 0.05 | 31.3 | 11.3 | 4.2 |

What is claimed is:

1. A treatment preparation for providing durable hydrophilic characteristics to hydrophobic fibrous substrates consisting of polyacrylic acid, a wetting agent and 2-butyloctanoic acid.

* * * * *